US010879649B2

(12) United States Patent
Liu

(10) Patent No.: US 10,879,649 B2
(45) Date of Patent: Dec. 29, 2020

(54) ELECTRICAL CONNECTOR

(71) Applicant: LOTES CO., LTD, Keelung (TW)

(72) Inventor: Jun Liu, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 16/590,549

(22) Filed: Oct. 2, 2019

(65) Prior Publication Data

US 2020/0112128 A1 Apr. 9, 2020

(30) Foreign Application Priority Data

Oct. 9, 2018 (CN) ..... 2018 1 1170244

(51) Int. Cl.

| | |
|---|---|
| ***H01R 13/405*** | (2006.01) |
| ***H01R 13/6473*** | (2011.01) |
| ***H01R 13/24*** | (2006.01) |
| ***H01R 13/502*** | (2006.01) |
| ***H01R 13/6585*** | (2011.01) |

(52) U.S. Cl.

CPC ..... *H01R 13/6473* (2013.01); *H01R 13/2442* (2013.01); *H01R 13/405* (2013.01); *H01R 13/502* (2013.01); *H01R 13/6585* (2013.01)

(58) Field of Classification Search

CPC .... H01R 12/716; H01R 24/60; H01R 12/721; H01R 12/57

See application file for complete search history.

(56) References Cited

U.S. PATENT DOCUMENTS

| | | | | |
|---|---|---|---|---|
| 8,057,263 | B1 * | 11/2011 | Howard | H01R 12/721 439/631 |
| 9,728,885 | B2 * | 8/2017 | Yokoyama | H01R 13/6585 |
| 2002/0132529 | A1 * | 9/2002 | Tharp | H01R 12/721 439/660 |
| 2005/0112920 | A1 * | 5/2005 | Venaleck | H01R 13/6589 439/92 |
| 2007/0111597 | A1 * | 5/2007 | Kondou | H05K 3/3485 439/581 |
| 2011/0189891 | A1 * | 8/2011 | Suzuki | H01R 13/648 439/607.01 |
| 2016/0233617 | A1 * | 8/2016 | Yen | H01R 13/6583 |
| 2016/0365673 | A1 * | 12/2016 | Liang | H01R 13/6469 |

(Continued)

FOREIGN PATENT DOCUMENTS

| | | |
|---|---|---|
| CN | 102195173 B | 6/2015 |
| CN | 103996933 B | 4/2016 |
| CN | 104064909 B | 1/2018 |

*Primary Examiner* — Truc T Nguyen

(74) *Attorney, Agent, or Firm* — Locke Lord LLP; Tim Tingkang Xia, Esq.

(57) ABSTRACT

An electrical connector is used to electrically connect a first component to a second component. The electrical connector includes multiple terminals. Each terminal has a connecting portion, a first conduction portion and a second conduction portion. The first conduction portion extends forward from the connecting portion to be electrically connected to the first component, and has a first contact point in contact with the first component. The second conduction portion extends backward from the connecting portion to be electrically connected to the second component, and has a second contact point in contact with the second component. A distance between the first contact point and the second contact point is 7.46±0.4 mm.

20 Claims, 14 Drawing Sheets

(56) References Cited

U.S. PATENT DOCUMENTS

| | | | | |
|---|---|---|---|---|
| 2017/0033520 | A1* | 2/2017 | Cheng | H01R 13/405 |
| 2017/0070009 | A1* | 3/2017 | Chen | H01R 43/24 |
| 2017/0085039 | A1* | 3/2017 | Yokoyama | H01R 24/60 |
| 2018/0131145 | A1* | 5/2018 | Zhao | H01R 13/6474 |
| 2018/0233848 | A1* | 8/2018 | Lin | H01R 13/405 |
| 2018/0233853 | A1* | 8/2018 | Janowiak | H01R 13/504 |
| 2020/0112129 | A1* | 4/2020 | Liu | H01R 13/6585 |

* cited by examiner

ELECTRICAL CONNECTOR

CROSS-REFERENCE TO RELATED PATENT APPLICATION

This non-provisional application claims priority to and the benefit of, pursuant to 35 U.S.C. § 119(a), patent application Serial No. CN201811170244.9 filed in China on Oct. 9, 2018. The disclosure of the above application is incorporated herein in its entirety by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference were individually incorporated by reference.

FIELD

The present invention relates to an electrical connector, and in particular to an electrical connector for high-frequency transmission.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

A conventional electrical connector includes an insulating body. The insulating body includes an insulating block, which is injection-molded with two rows of terminals integrally. Each terminal has a fixing portion embedded in the insulating block. A contact portion extends forward from the fixing portion, and the contact portion has an arc-shaped contact point in contact with a mating connector. A pin extends backward from the fixing portion, and the pin has a contact portion in contact with a circuit board.

The transmission rate of an electrical connector in the related art is 40 Gbps. However, with the development of the digital technology, the 40 Gbps transmission rate of the electrical connector is apparently not sufficient. An electrical connector 100 having a higher transmission rate is needed.

Therefore, a heretofore unaddressed need to design a novel electrical connector exists in the art to address the aforementioned deficiencies and inadequacies.

SUMMARY

The present invention is directed to an electrical connector enabling a distance between a contact position of a terminal and a mating connector and a contact position of the terminal and a circuit board to be smaller than that in the related art, so as to improve the transmission rate.

In order to achieve the foregoing objective, the present invention adopts the following technical solutions: an electrical connector is configured to electrically connect a first component to a second component. The electrical connector includes a plurality of terminals. Each of the terminals includes: a connecting portion; a first conduction portion, extending forward from the connecting portion and configured to be electrically connected to the first component, wherein the first conduction portion has a first contact point in contact with the first component; and a second conduction portion, extending backward from the connecting portion and configured to be electrically connected to the second component, wherein the second conduction portion has a second contact point in contact with the second component. A distance between the first contact point and the second contact point is 7.46±0.4 mm.

In certain embodiments, the electrical connector further includes an insulating block, wherein the connecting portion of each of the terminals is fixed in the insulating block, the connecting portion of each of the terminals extends forward out of a front surface of the insulating block and backward out of a rear surface of the insulating block, and a distance between the front surface and the rear surface of the insulating block is 3.45±0.2 mm.

In certain embodiments, the terminals are arranged in a row in a left-right direction, and the terminals in the row have a pair of differential signal terminals and a power terminal located at one side of the differential signal terminals, the electrical connector further comprises an insulating block, the connecting portion of each of the terminals is fixed in the insulating block, the insulating block has a first groove and a second groove located at one side of the first groove, the connecting portion of each of the terminals has two opposite sides in the left-right direction, one of the two opposite sides of the connecting portion of the power terminal is exposed in the first groove, the other of the two opposite sides of the connecting portion of the power terminal is embedded in the insulating block, and the two opposite sides of the connecting portion of each of the pair of differential signal terminals are both exposed in the second groove.

In certain embodiments, a size of the first groove is smaller than a size of the second groove in a front-rear direction, and the size of the first groove is greater than the size of the second groove in the left-right direction.

In certain embodiments, the connecting portion of each of the differential signal terminals comprises a first section, a second section located behind the first section, and a transition portion connecting the first section and the second section, a distance between two adjacent first sections is greater than a distance between two adjacent second sections, the second groove has a wall surface, and a projection of the wall surface in a vertical direction is on a joint of the transition portion and the second section.

In certain embodiments, the terminals are arranged in an upper row and a lower row in a vertical direction, the electrical connector further comprises an upper insulating block and a lower insulating block vertically matching each other, the terminals in the upper row are fixed to the upper insulating block, the terminals in the lower row are fixed to the lower insulating block, the upper insulating block has an upper matching surface facing the lower insulating block, the lower insulating block has a lower matching surface facing the upper insulating block, and a shielding sheet is clamped between the upper matching surface and the lower matching surface.

In certain embodiments, the second conduction portion of each of the terminals in the upper row extends backward out of a rear surface of the upper insulating block, the second conduction portion of each of the terminals in the lower row extends backward out of a rear surface of the lower insulating block, the shielding sheet extends backward out of the rear surface of the upper insulating block and the rear surface of the lower insulating block, and the second component is clamped between the second conduction portions in the upper row and the lower row and abuts the shielding sheet.

In certain embodiments, the shielding sheet has a base, a first protruding portion extending forward from a center of a front end of the base, and two second protruding portions respectively located at a left side and a right side of the first protruding portion, and the base, the first protruding portion and the second protruding portions are all clamped between the upper matching surface and the lower matching surface.

In certain embodiments, the base has at least one positioning hole, two notches are respectively formed between the first protruding portion and the two second protruding portions, at least one positioning post and two position limiting protrusions are located between the upper matching surface and the lower matching surface, the positioning post is accommodated in the positioning hole, the two position limiting protrusions are accommodated in the two notches respectively, and the position limiting protrusions are higher than the positioning post.

In certain embodiments, at least one stopping portion is located between the upper matching surface and the lower matching surface and is located in front of at least one of the two second protruding portions, and is configured to stop the second protruding portions backward.

In certain embodiments, two stopping portions are provided at an interval at two sides of a front end of the upper matching surface or at two sides of a front end of the lower matching surface, an opening is located between the two stopping portions, and the first protruding portion is exposed in the opening.

In certain embodiments, the electrical connector further includes an insulating body, wherein the terminals are accommodated in the insulating body, a mating cavity is concavely provided on a front end of the insulating body and configured to mate with the first component, an accommodating cavity is concavely provided on a rear end of the insulating body and configured to accommodate the second component, the first conduction portion is accommodated in the mating cavity, the first contact point is located in the mating cavity, the second conduction portion is accommodated in the accommodating cavity, and the second contact point is located in the accommodating cavity.

In order to achieve the foregoing objective, the present invention further adopts the following technical solutions: an electrical connector is configured to electrically connect a first component to a second component. The electrical connector includes: an insulating body, comprising a mating cavity configured to mate with the first component; and a plurality of terminals fixed to the insulating body and arranged in an upper row and a lower row inside the mating cavity in a vertical direction. Each of the terminals includes: a connecting portion; a first conduction portion, extending forward from the connecting portion and configured to be electrically connected to the first component, and a second conduction portion, extending backward from the connecting portion and configured to be electrically connected to the second component. The connecting portion of each of the terminals in the upper row corresponds to the connecting portion of a corresponding one of the terminals in the lower row, and a distance between the connecting portion of each of the terminals in the upper row and the connecting portion of the corresponding one of the terminals in the lower row is 1.02±0.1 mm.

In certain embodiments, the electrical connector further includes an insulating block accommodated in the insulating body, wherein the connecting portion of each of the terminals is embedded in the insulating block, the first conduction portion has a first contact point in electrical contact with the first component, the second conduction portion has a second contact point in electrical contact with the second component, and a distance between the first contact point and the connecting portion in the vertical direction is greater than a distance between the second contact point and the connecting portion in the vertical direction.

In certain embodiments, the terminals in the upper row and the terminals in the lower row are respectively arranged in a left-right direction, and the terminals in each of the upper row and the lower row have a pair of differential signal terminals and a power terminal located at one side of the differential signal terminals, the electrical connector further comprises an insulating block, the terminals are fixed in the insulating block, the insulating block has a first groove and a second groove, the connecting portion of each of the terminals has two opposite sides in the left-right direction, one of the two opposite sides of the connecting portion of the power terminal is exposed in the first groove, the other of the two opposite sides of the connecting portion of the power terminal is embedded in the insulating block, and the two opposite sides of the connecting portion of each of the pair of differential signal terminals are both exposed in the second groove.

In certain embodiments, the electrical connector further includes an upper insulating block and a lower insulating block vertically matching each other, wherein the terminals in the upper row are fixed to the upper insulating block, the terminals in the lower row are fixed to the lower insulating block, the upper insulating block has an upper matching surface facing the lower insulating block, the lower insulating block has a lower matching surface facing the upper insulating block, and a shielding sheet is clamped between the upper matching surface and the lower matching surface.

In certain embodiments, the second conduction portion of each of the terminals in the upper row extends backward out of a rear surface of the upper insulating block, the second conduction portion of each of the terminals in the lower row extends backward out of a rear surface of the lower insulating block, the shielding sheet extends backward out of the rear surface of the upper insulating block and the rear surface of the lower insulating block, and the second component is clamped between the second conduction portions in the upper row and the lower row and abuts the shielding sheet.

In certain embodiments, the shielding sheet has a base, a first protruding portion extending forward from a center of a front end of the base, and two second protruding portions respectively located at two sides of the first protruding portion, the base, the first protruding portion and the two second protruding portions are all clamped between the upper matching surface and the lower matching surface, the base has at least one positioning hole, two notches are respectively formed between the first protruding portion and the two second protruding portions, at least one positioning post and two position limiting protrusions are located between the upper matching surface and the lower matching surface, the positioning post is accommodated in the positioning hole, the two position limiting protrusions are accommodated in the two notches respectively, and the position limiting protrusions are higher than the positioning post.

In certain embodiments, at least one stopping portion is located between the upper matching surface and the lower matching surface and is located in front of at least one of the two second protruding portions, and is configured to stop the second protruding portions backward.

In certain embodiments, an accommodating cavity is provided at a rear end of the insulating body and configured to accommodate the second component, the first conduction portion has a first contact point in contact with the first component, the first contact point is located in the mating cavity, the second conduction portion is accommodated in the accommodating cavity, the second conduction portion has a second contact point in contact with the second component, the second contact point is located in the accommodating cavity, and a distance between the first contact point and the second contact point is 7.46±0.4 mm.

Compared with the related art, the distance between the first contact point and the second contact point is reduced to 7.46±0.4 mm, an impedance curve of the terminals is completely within a standard range of the impedance, and the fluctuation of the impedance curve is smaller than that of the terminal impedance curve in the related art, such that the terminals have good impedance characteristics, and the impedance of the terminals is balanced, thereby facilitating the stability of high-frequency transmission performance. Further, the distance between the connecting portion in the upper row and the connecting portion in the lower row in the vertical direction is increased to 1.02±0.2 mm. Compared with the related art, an impedance curve of the terminals is completely within a standard range of the impedance, and the fluctuation of the impedance curve is smaller than that of the terminal impedance curve in the related art, such that the terminals have good impedance characteristics, and the impedance of the terminals is balanced, thereby facilitating the stability of high-frequency transmission performance.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment, and wherein.

DETAILED DESCRIPTION

Figure 1:
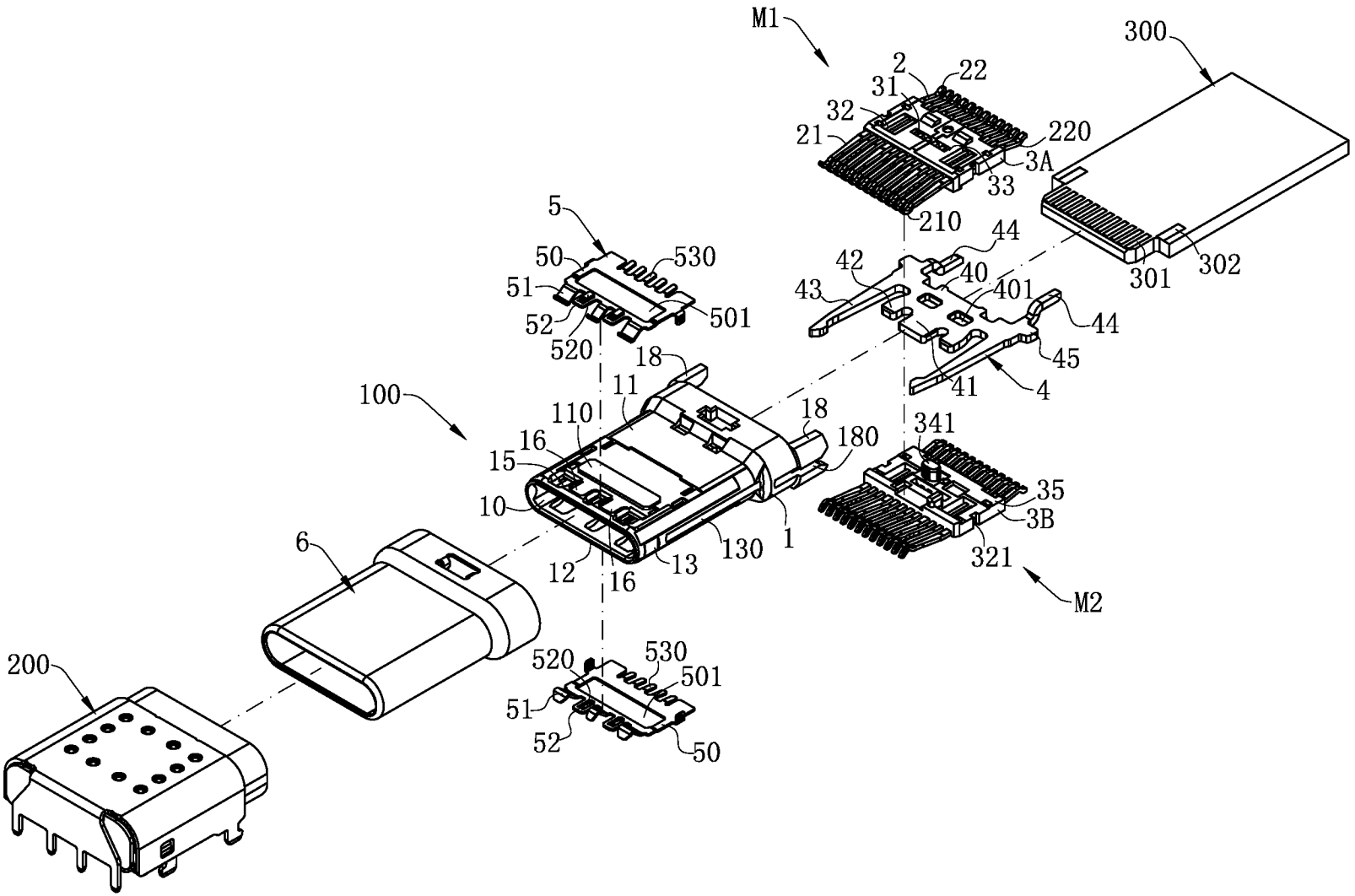
FIG. 1 is a perspective exploded view of an electrical connector according to certain embodiments of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated. As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-14. In accordance with the purposes of this invention, as embodied and broadly described herein, this invention, in one aspect, relates to an electrical connector.

Figure 2:
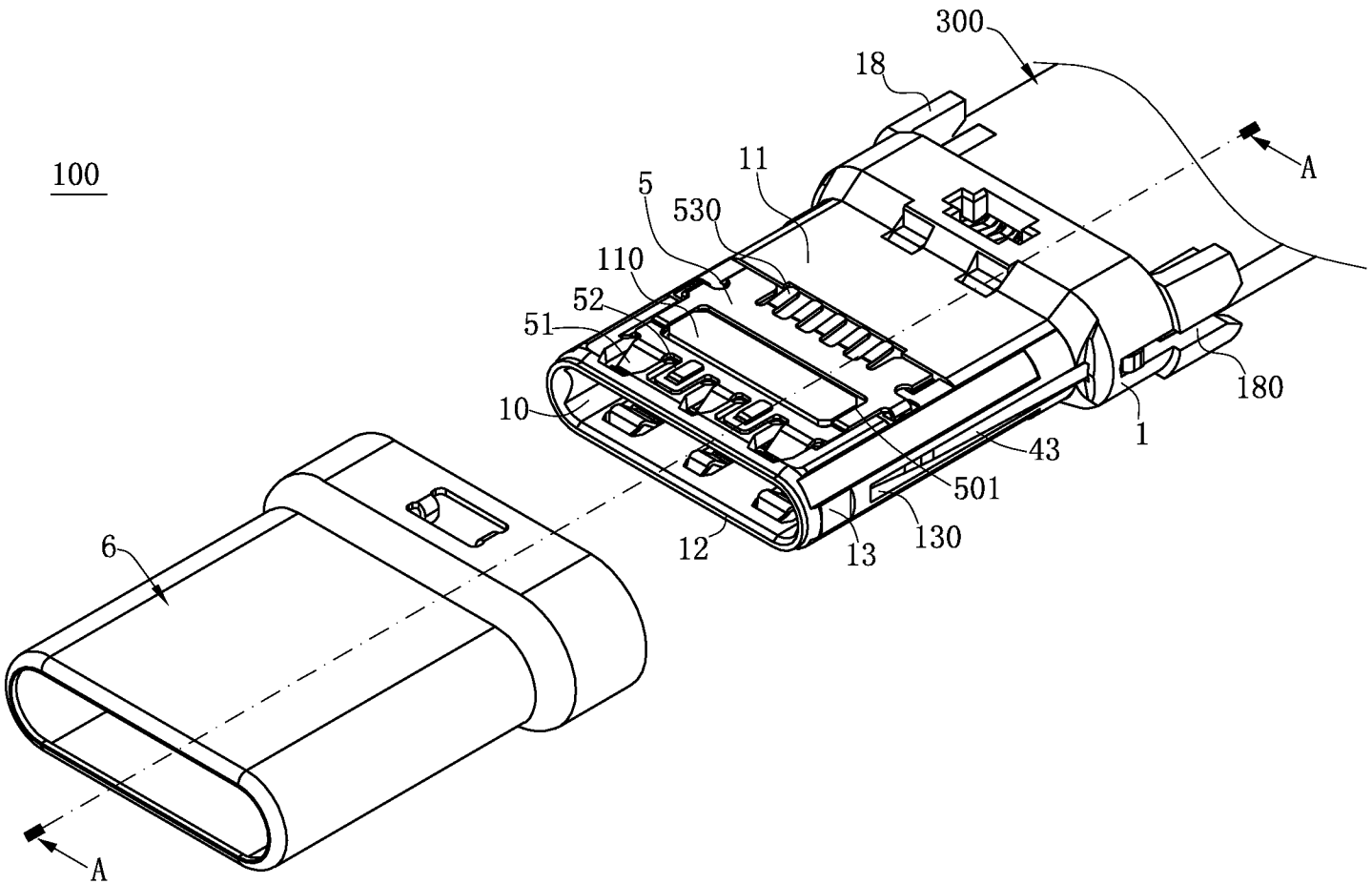
FIG. 2 is a perspective view of the electrical connector in FIG. 1.
Figure 3:
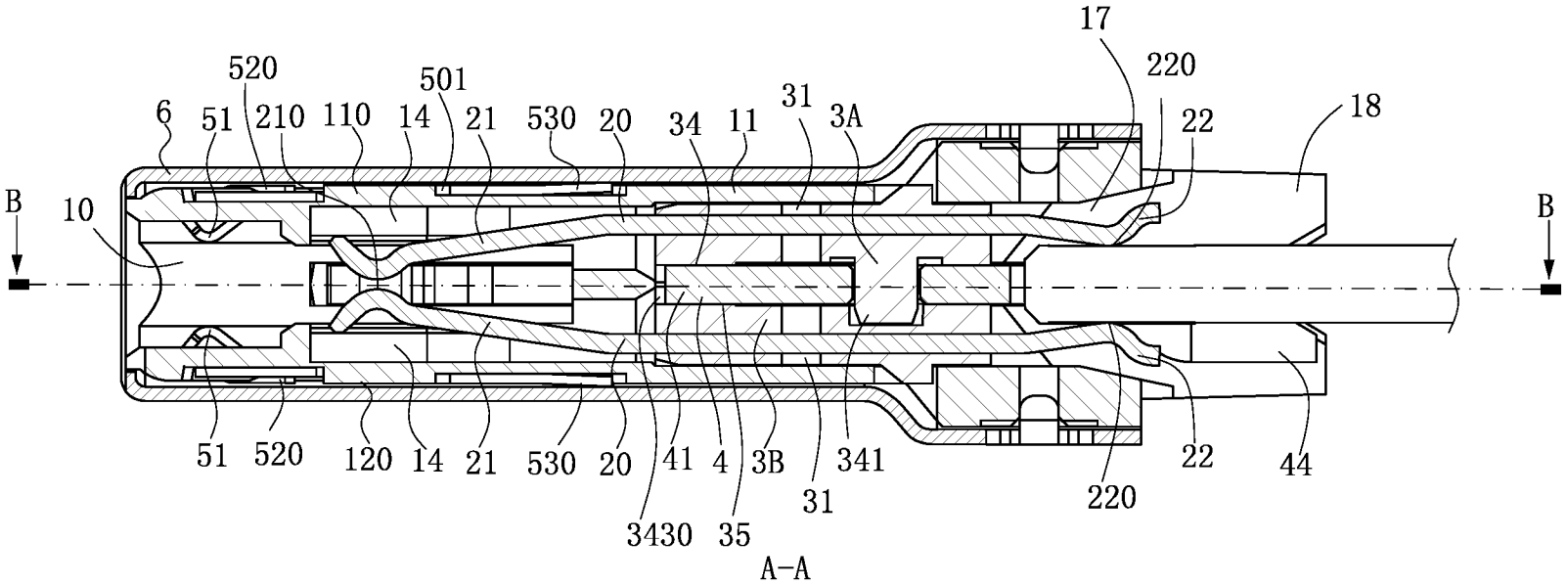
FIG. 3 is a sectional view of the electrical connector in FIG. 2 along the A-A direction.

Referring to FIG. 1, FIG. 2 and FIG. 3, an electrical connector 100 according to an embodiment of the present invention is shown. The electrical connector 100 according to this embodiment is a Type-C plug connector, and the electrical connector 100 is mated with a socket connector 200 forward and mounted on a circuit board 300 backward. The electrical connector 100 includes an insulating body 1, and a first terminal module M1, a second terminal module M2 and a shielding sheet 4 are accommodated in the insulating body 1. The shielding sheet 4 is located between the first terminal module M1 and the second terminal module M2. Two grounding sheets 5 are 180° longitudinally symmetrical to each other, and respectively cover an upper surface and a lower surface of the insulating body 1. A metal shell 6 wraps the two grounding sheets 5 and the insulating body 1.

Referring to FIG. 1, FIG. 2 and FIG. 3, a mating cavity 10 is concavely provided on a front end of the insulating body 1 and is used to mate with the socket connector 200. The mating cavity 10 is formed by an upper plate 11, a lower plate 12, and two side plates 13 connecting the upper plate 11 and the lower plate 12. An upper protruding portion 110 protrudes upward from an upper surface of the upper plate 11, a lower protruding portion 120 protrudes from a lower surface of the lower plate 12, and the upper protruding portion 110 and the lower protruding portion 120 are provided to be longitudinally symmetrical. Each side plate 13 has a channel 130 penetrating therethrough, and the channel 130 is in communication with the mating cavity 10. Multiple terminal slots 14 are divided into two rows longitudinally symmetrical to each other and are respectively provided on the upper plate 11 and the lower plate 12. Each terminal slot 14 is in communication with the mating cavity 10. The terminal slots 14 in the upper row do not run through the upper plate 11 upward, and the terminal slots 14 in the lower row do not run through the lower plate 12 downward. The upper protruding portion 110 is close to the front ends of the terminal slots 14 in the upper row, and the lower protruding portion 120 is close to the front ends of the terminal slots 14 in the lower row. Multiple through holes 15 are provided on the upper plate 11 and the lower plate 12 and form an upper row and a lower row respectively. The through holes 15 in the upper row run through the upper plate 11, the through holes 15 in the lower row run through the lower plate 12, and each through hole 15 is located in front of all of the terminal slots 14. A non-through hole 16 is provided between each two adjacent through holes 15 in the same row. Each non-through hole 16 in the upper row does not run through the upper plate 11, and each non-through hole 16 in the lower row does not run through the lower plate 12.

Referring to FIG. 1, FIG. 2 and FIG. 3, an accommodating cavity 17 is concavely provided on a rear end of the insulating body 1, and the circuit board 300 is inserted into the accommodating cavity 17. Two side walls 18 extend from two sides of the rear end of the insulating body 1 respectively. Each side wall 18 has a via hole 180 running outward therethrough, and each via hole 180 is in communication with the outside and the accommodating cavity 17.

Figure 6:
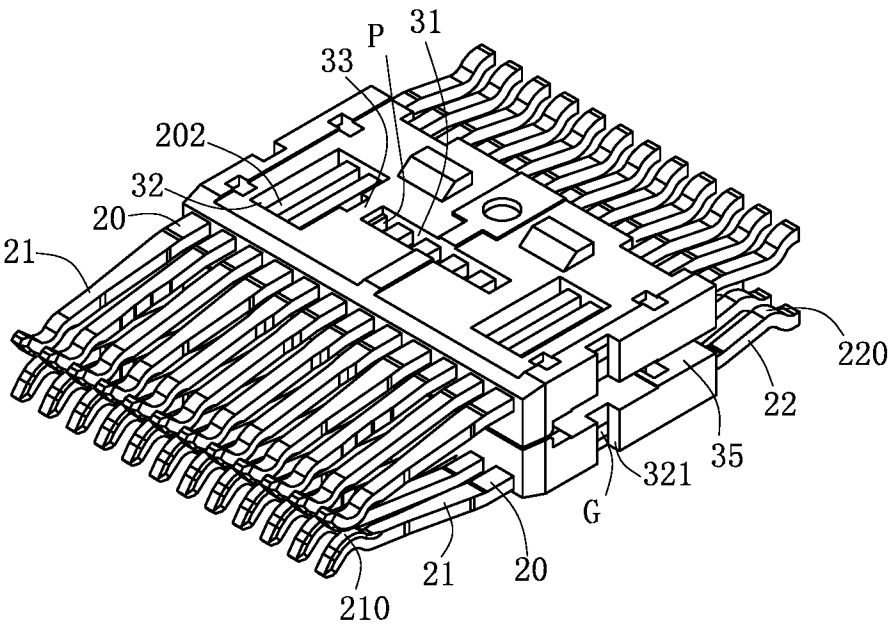
FIG. 6 is a perspective assembled view of the first terminal module, the second terminal module and the middle shielding sheet of the electrical connector in FIG. 1.
Figure 7:
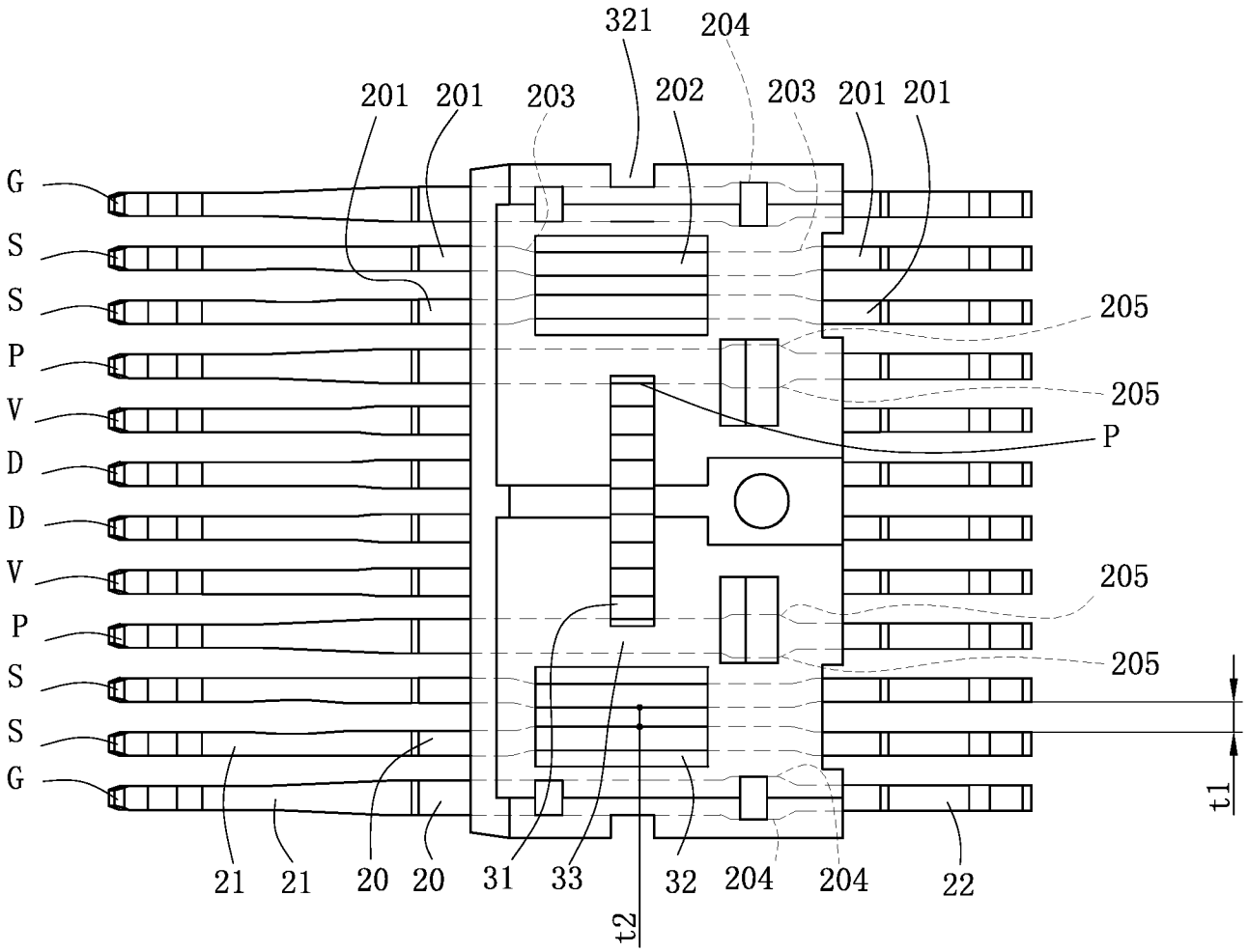
FIG. 7 is a top view of the first terminal module in FIG. 3.
Figure 8:
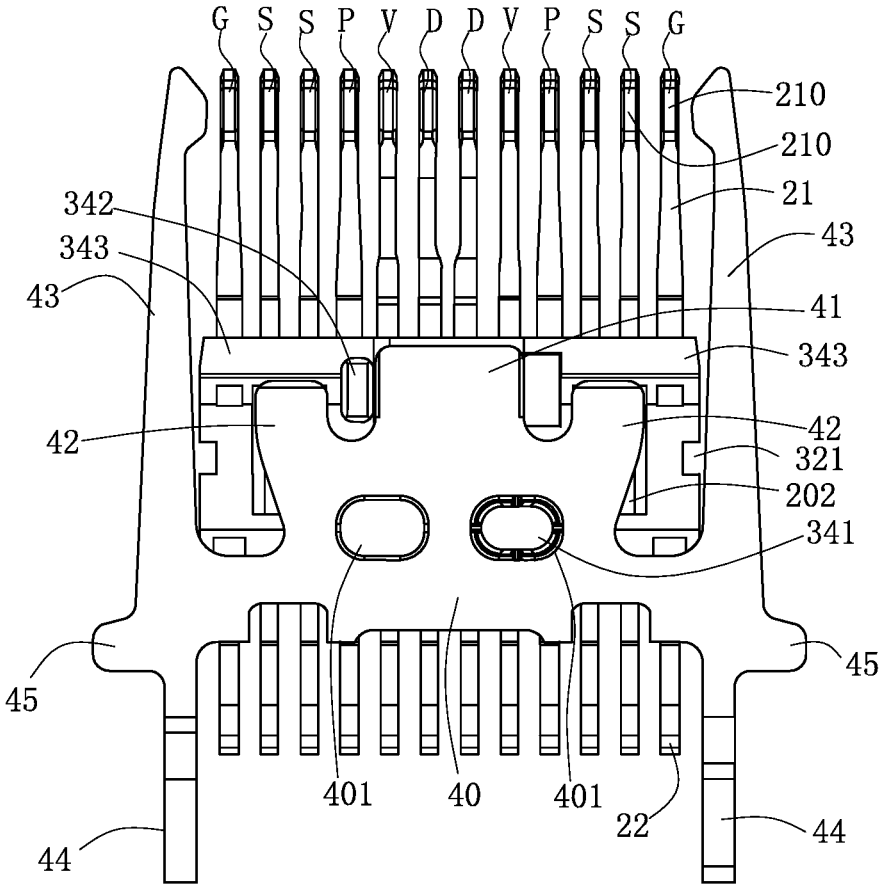
FIG. 8 is a top view of the second terminal module and the middle shielding sheet in FIG. 3.

Referring to FIG. 1, FIG. 6 and FIG. 7, multiple terminals 2 are arranged in an upper row and a lower row and are provided to be 180° symmetrical. The quantity of the terminals 2 in each row is 12, and the terminals 2 in each row include, sequentially from left to right, a ground terminal G, a pair of differential signal terminals S (high-speed terminals) for transmitting USB 3.0 signals, a power terminal P, a reserved terminal V, a pair of USB 2.0 terminals D, a reserved terminal V, a power terminal P, a pair of differential signal terminals S (high-speed terminals) for transmitting the USB 3.0 signals, and a ground terminal G. The reserved terminals V can be used for detection, or can be used as signal or power supply terminals.

Figure 9:
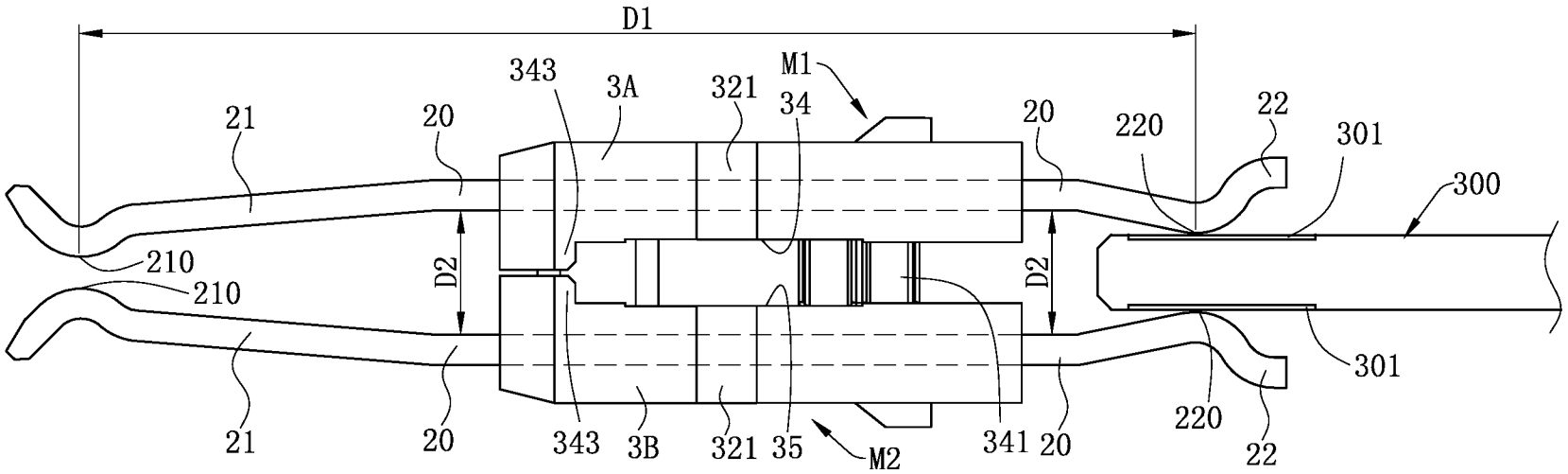
FIG. 9 is a side view of the first terminal module and the second terminal module after being assembled.

Referring to FIG. 7 and FIG. 9, each terminal 2 has a connecting portion 20. The connecting portions 20 of the terminals 2 are located on a same horizontal plane in a front-rear direction, and a length of each connecting portion 20 in the front-rear direction is 4.31±0.2 mm. The connecting portion 20 of each differential signal terminal S has two first sections 201 located at a front end and a rear end of the connecting portion 20, a second section 202 located between the two first sections 201, and two transition sections 203 connected to the two first sections 201 at two ends of the second section 202 respectively. A distance t2 between two adjacent second sections 202 is smaller than a distance t1 between two adjacent first sections 201. A first bump 204 protrudes outward from each of two sides of the connecting portion 20 of each ground terminal G, and one of the first bumps 204 adjacent to the differential signal terminal S protrudes toward the second section 202 of the adjacent differential signal terminal S, thereby reducing the distance between the ground terminal G and the adjacent differential signal terminal S. A second bump 205 protrudes outward from each of two sides of the connecting portion 20 of each power terminal P. The two second bumps 205 increase the area of the power terminal P and facilitate transmission of more currents. The first bumps 204 and the second bumps 205 are arranged in a row in a left-right direction.

Figure 10:
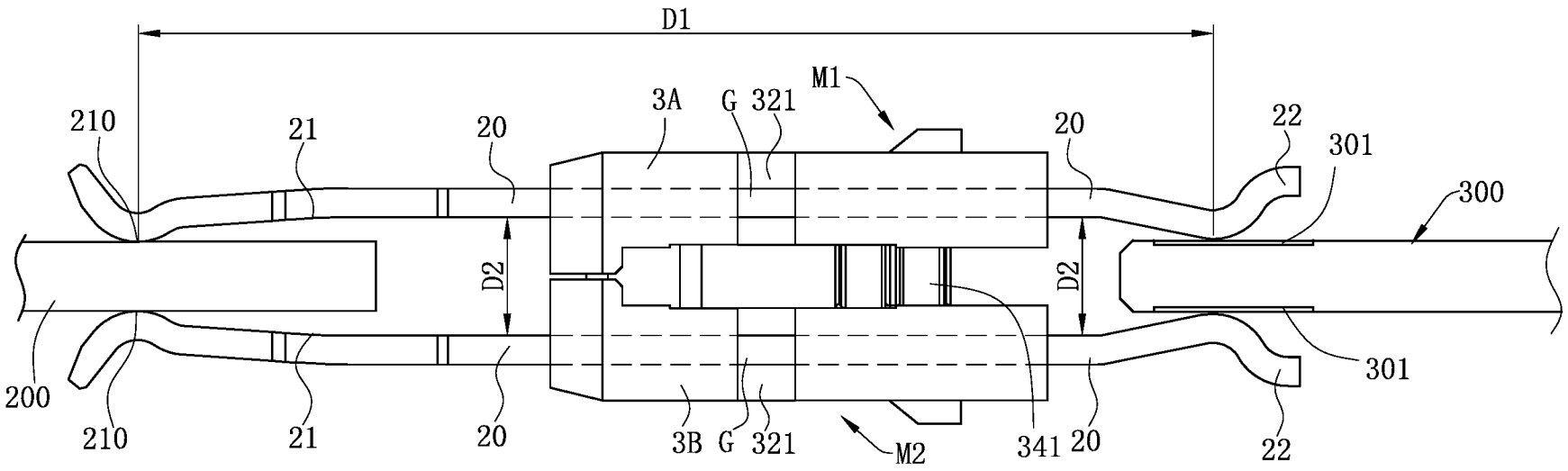
FIG. 10 is a side view of a socket connector being inserted between the first terminal module and the second terminal module in FIG. 9.

Referring to FIG. 6, FIG. 9 and FIG. 10, a first conduction portion 21 bends and extends forward from the front end of the connecting portion 20 along the vertical direction, and a second conduction portion 22 bends and extends backward from the rear end of the connecting portion 20 along the vertical direction. A tail end of the first conduction portion 21 is arc-shaped to form a first contact point 210. The first contact point 210 of each terminal 2 in the upper row is arched downward, and the first contact point 210 of each terminal 2 in the lower row is arched upward. The first contact point 210 is in mechanical contact with the socket connector 200. A tail end of the second conduction portion 22 is arc-shaped to form a second contact point 220. The second contact point 220 of each terminal 2 in the upper row is arched downward, and the second contact point 220 of each terminal 2 in the lower row is arched upward. Each terminal 2 has the following characteristics: a distance between the first contact point 210 and the connecting portion 20 in the vertical direction is greater than a distance between the second contact point 220 and the connecting portion 20 in the vertical direction, and a distance D1 between the first contact point 210 and the second contact point 220 is 7.46±0.4 mm. A distance D2 between the connecting portion 20 of each terminal 2 in the upper row and the connecting portion 20 of a corresponding terminal 2 in the lower row in the vertical direction is 1.02±0.2 mm. In a comparative embodiment, the length of the terminal 2 is 9.21±0.2 mm, D1 is 7.94 mm, and D2 is 0.95 mm. In comparison, in the present embodiment, the length of the terminal 2 is 8.55 mm, the length of the terminal 2 and the distance D1 between the first contact point 210 and the second contact point 220 are reduced, and the distance D2 between the connecting portions 20 in two rows is increased.

Figure 11:
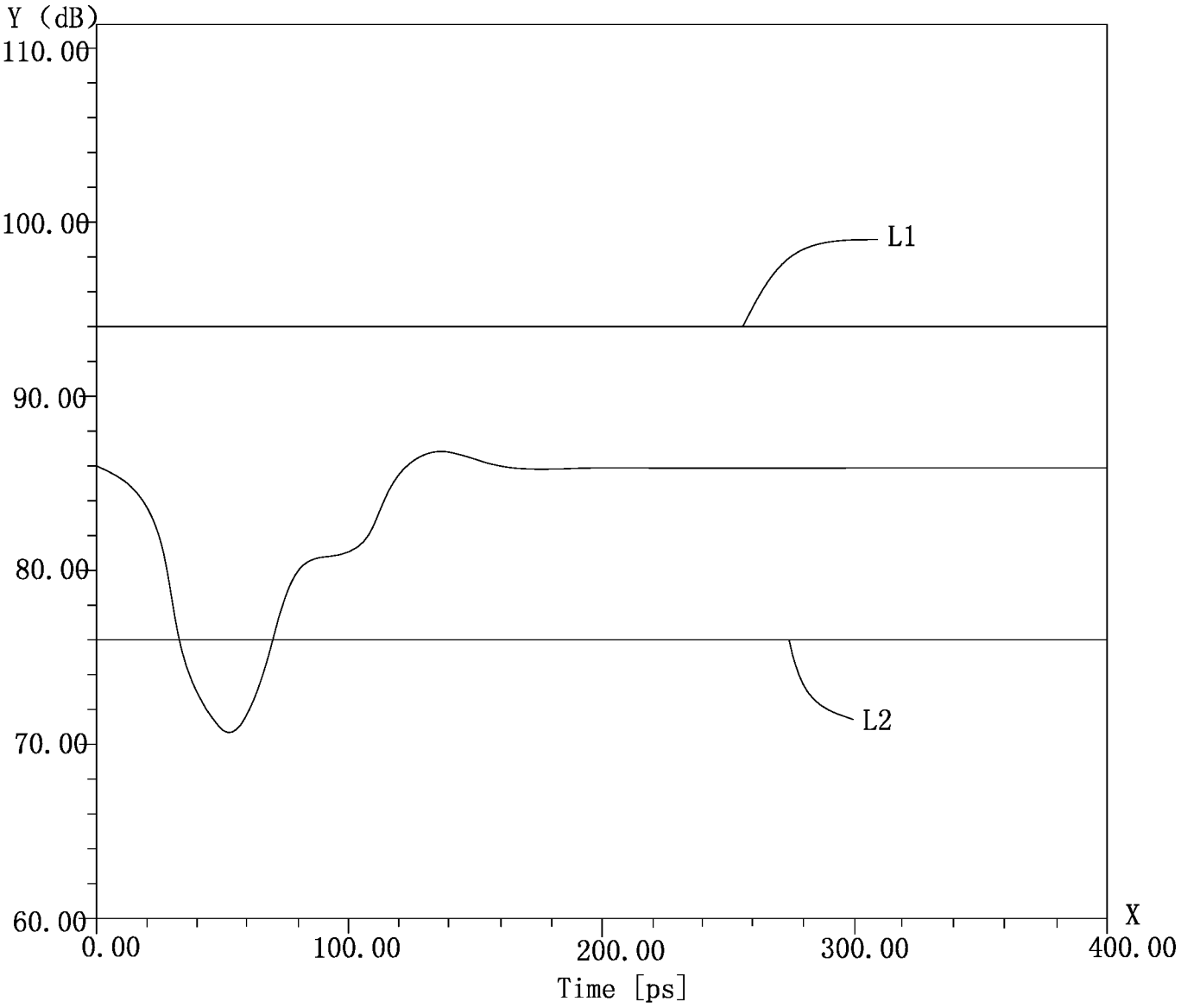
FIG. 11 (Related Art)
FIG. 11 is a curve diagram of terminal impedance in the related art.

Referring to FIG. 10 and FIG. 11, a straight line L1 and a straight line L2 are standard range values of the impedance of the Type-C electrical connector 100. In FIG. 10 and FIG. 11, it can be seen that the range of the standard impedance is 76 to 94 Ω, the fluctuation of a front half part of the curve is greater than that of a rear half part of the curve, and the front half part of the curve represents the impedance of the terminals 2. The curve part in FIG. 10 has passed beyond the foregoing standard impedance range, and the curve in FIG. 11 is completely within the foregoing standard impedance range. Further, the fluctuation of the front half part of the impedance curve is smaller than that of the impedance curve of the terminal 2 in the related art. For the terminals 2 in this embodiment, D1 is reduced, and D2 is increased, such that the impedance of the terminals 2 is within a standard range, the fluctuation is small, and the impedance is balanced, thereby facilitating the stability of high-frequency transmission performance.

Figure 12:
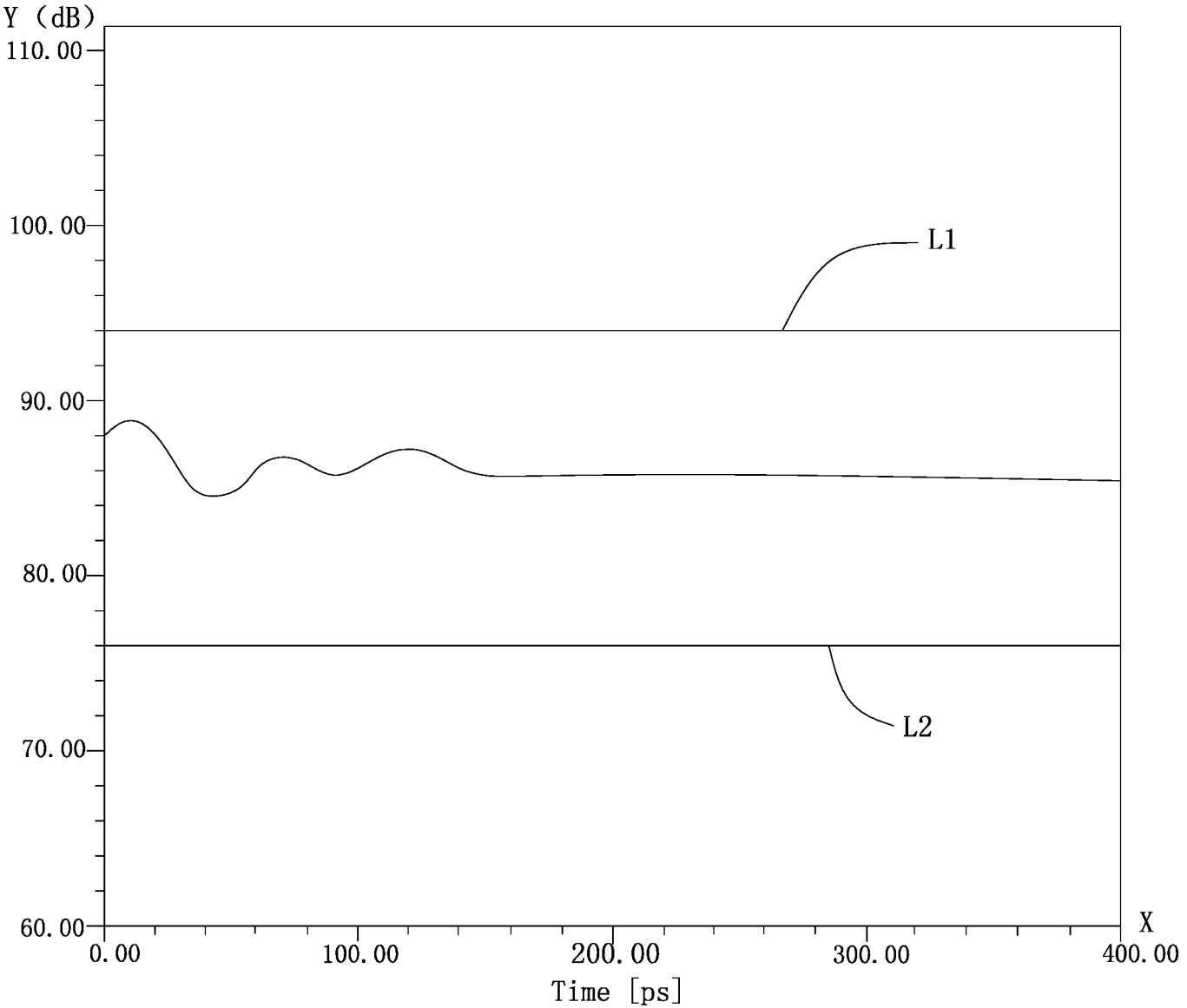
FIG. 12 is a curve diagram of terminal impedance according to an embodiment of the present invention.
Figure 13:
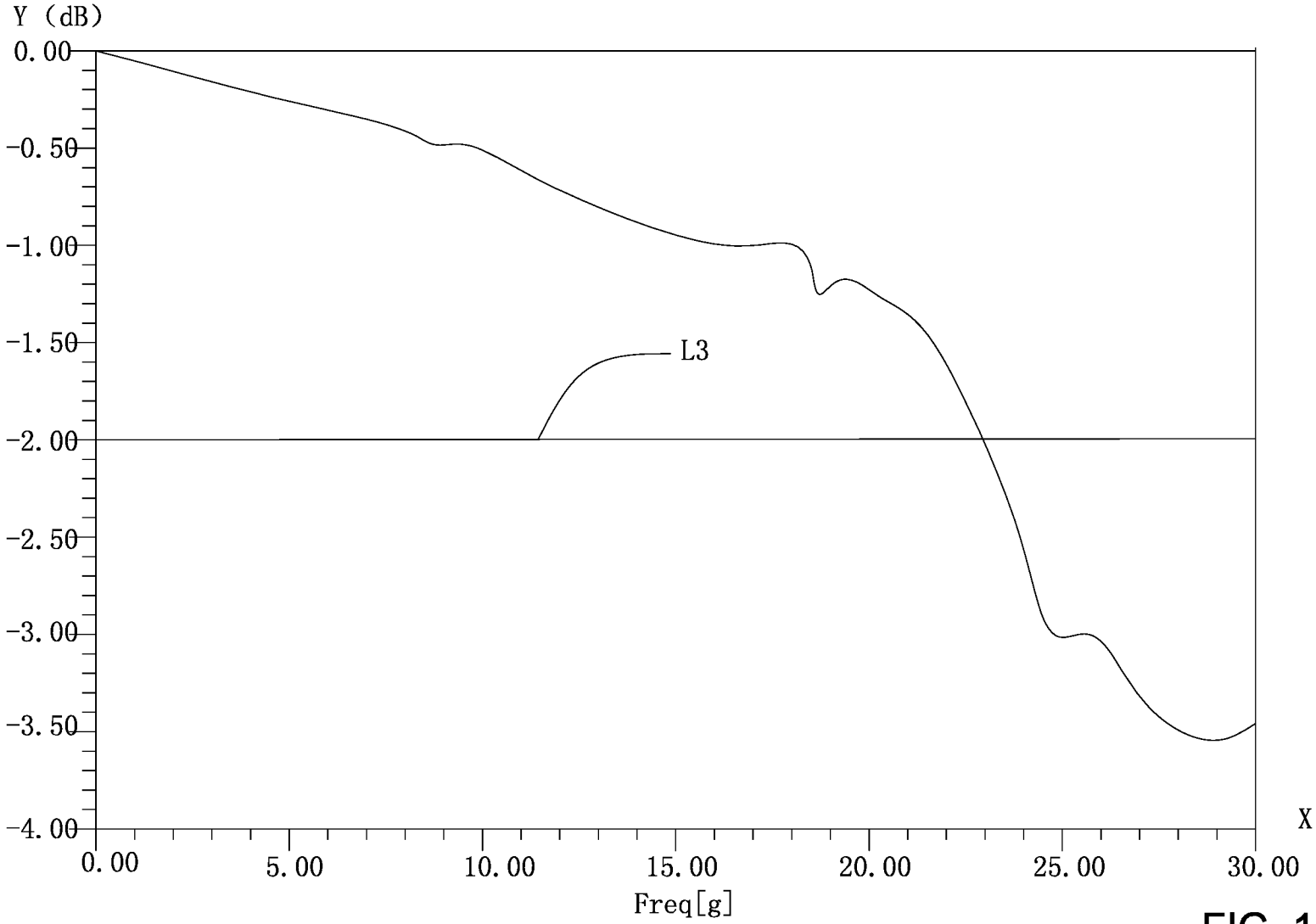
FIG. 13 (Related Art)
FIG. 13 is a curve diagram of terminal insertion loss in the related art.
Figure 14:
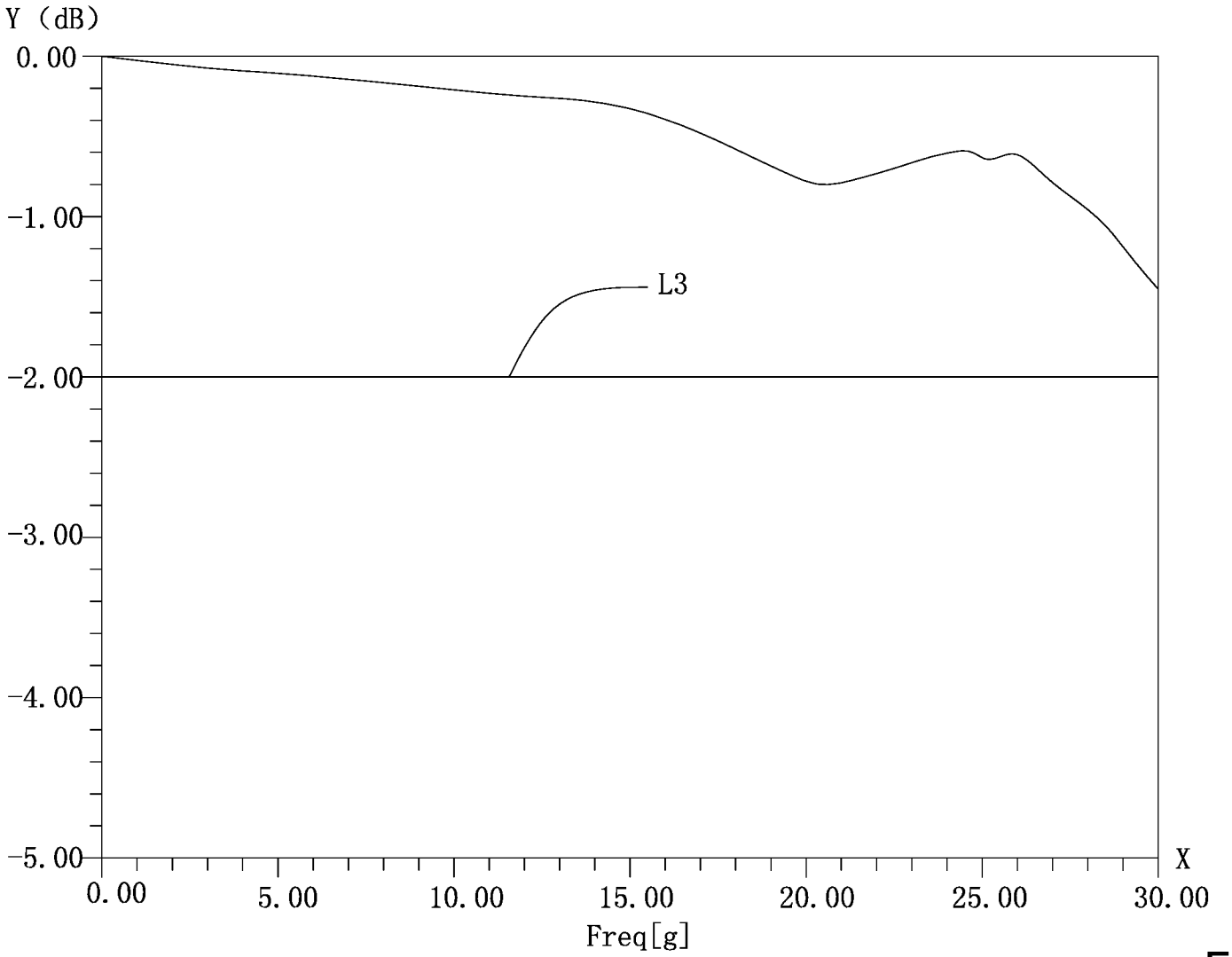
FIG. 14 is a curve diagram of terminal insertion loss according to an embodiment of the present invention.

Referring to FIG. 12 and FIG. 13, a straight line L3 is a standard line of insertion loss, the X axis represents the Nyquist frequencies, and the transmission rate of the electrical connector 100 is approximately twice as high as the Nyquist frequencies thereof. An equation of the Y axis is: Y=−log(output work/input work) dB. As the output work is closer to the input work, that is, Y is approximately 0, the performance of the electrical connector 100 is the best, and as Y is closer to 0 dB, the performance of the electrical connector 100 is better. When the high-frequency transmission rate of the curve in FIG. 12 is about 20 GHz, an insertion loss curve falls out of the foregoing standard range, and as the Nyquist frequencies become higher, the value of Y is farther away from the standard line of the insertion loss. Therefore, the transmission rate of the conventional electrical connector 100 is about 40 Gbps. When the transmission rate is required to be higher to reach, e.g., 50 Gbps or 60 Gbps, the insertion loss of the terminals 2 has passed beyond the standard range of the insertion loss. As shown in FIG. 13, D1 for the terminals 2 in this embodiment is smaller than that in the related art, thereby reducing the length of a transmission path. When the Nyquist frequencies are in a range of 0 to 30 GHz, the insertion loss curve of the terminals 2 is within a standard range. Therefore, the transmission rate of the electrical connector 100 in this embodiment can be at least 60 Gbps. Compared with the transmission rate of the electrical connector 100 in the related art, the transmission rate of the electrical connector 100 in this embodiment is higher, and more meets demands of a current trend.

Referring to FIG. 7, FIG. 9 and FIG. 10, the first terminal module M1 is formed by the terminals 2 in the upper row and an upper insulating block 3A. The connecting portions 20 of the terminals in the upper row are injection molded and embedded into the upper insulating block 3A by insert-molding. The front end of each connecting portion 20 extends out of a front surface of the upper insulating block 3A, and a distance between the first conduction portion 21 and the front surface of the upper insulating block 3A is 3.55±0.2 mm. The rear end of each connecting portion 20 extends out of a rear surface of the upper insulating block 3A, and a distance between the tail end of the second conduction portion 22 and the rear surface of the upper insulating block 3A is 1.75±0.2 mm. A distance between the front surface and the rear surface of the upper insulating block 3A is 3.45±0.2 mm.

The upper insulating block 3A has a first groove 31 and two second grooves 32 located on two sides of the first groove 31. A partition spacer 33 is formed between each second groove 32 and the first groove 31, and a width of each partition spacer 33 is smaller than a width of the connecting portion 20 of the power terminal P. The first groove 31 and the second grooves 32 all run through the upper surface and the lower surface of the upper insulating block 3A. The size of the first groove 31 is smaller than the size of each second groove 32 in the front-rear direction. The size of each second groove 32 in the front-rear direction is approximately equal to half of the size of the upper insulating block 3A in the front-rear direction. The size of the first groove 31 in the left-right direction is greater than the size of each second groove 32 in the left-right direction. A positioning slot 321 is concavely provided on each of two sides of the upper insulating block 3A, and the positioning slots 321 and the first groove 31 are located in the same straight line.

Figure 5:
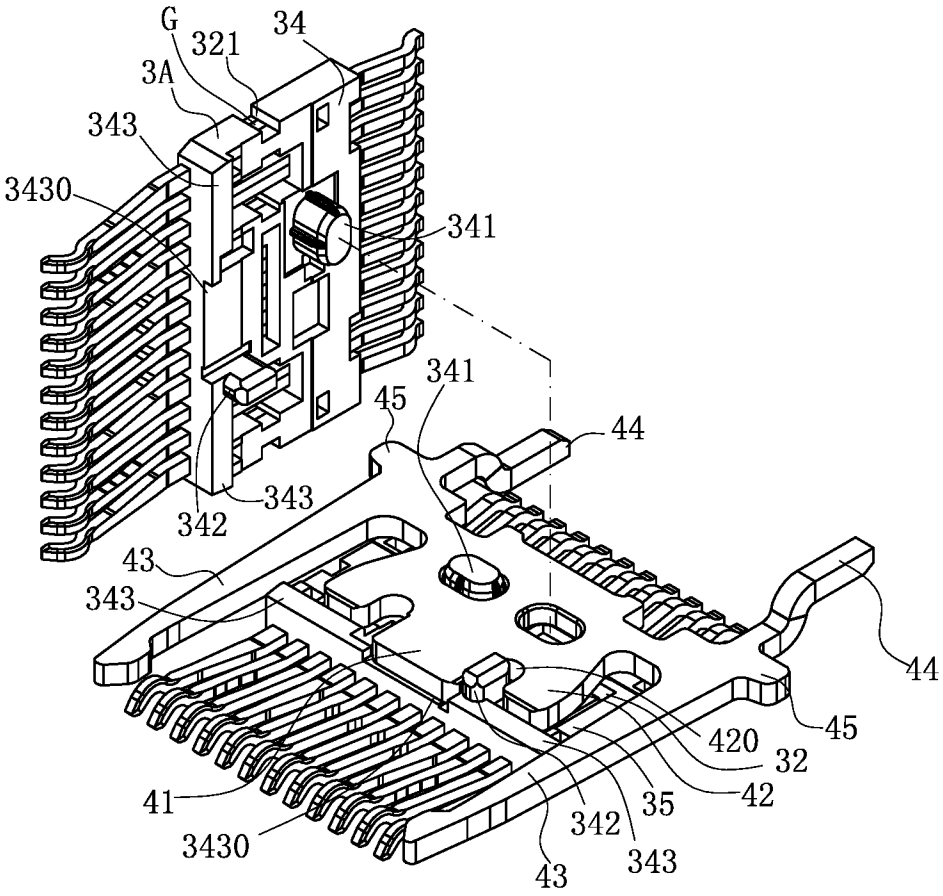
FIG. 5 is a perspective view of a first terminal module, a second terminal module and a middle shielding sheet of the electrical connector in FIG. 1.

Referring to FIG. 5, FIG. 6 and FIG. 7, each of the terminals 2 has two opposite sides in the left-right direction. The two power terminals P and the terminals 2 located between the two power terminals P are exposed in the first groove 31. One of the two opposite sides of the connecting portion 20 of each of the power terminals P is embedded in a corresponding one of the partition spacers 33, and the other of the two opposite sides of the connecting portion 20 of each of the power terminals P extends into the first groove 31, thereby facilitating heat dissipation of the power terminals P. Moreover, the power terminals P are exposed in air, facilitating that the side surface of each power terminal P can be fixed by a clamp in an injection molding process, thereby facilitating the positioning of the power terminals P. The two opposite sides of each pair of differential signal terminals S is correspondingly exposed in each second groove 32, and a projection of the front wall surface of each second groove 32 in the vertical direction is on a joint between the transition section 203 and the second section 202. The second section 202 is exposed in air. Since the distance between the differential signal terminals S in pair is reduced from t1 to t2 at the joint between the transition section 203 and the second section 202, a dielectric coefficient needs to be reduced correspondingly to maintain the stability of impedance. The second groove 32 is full of air, and the dielectric coefficient of the air is smaller than the dielectric coefficient of the upper insulating block 3A. Therefore, by providing the front wall surface of each second groove 32 at the joint between the transition section 203 and the second section 202 of each differential signal terminal S, the stability of impedance can be effectively maintained.

The side surface of each ground terminal G is exposed at the bottom of a corresponding positioning slot 321, facilitating that the side surface of each ground terminal G can be fixed by a clamp in an injection molding process, thereby facilitating the positioning of the ground terminals G.

Referring to FIG. 3, FIG. 5 and FIG. 9, the lower surface of the upper insulating block 3A forms an upper matching surface 34. A positioning post 341 and a position limiting protrusion 342 located in front of the positioning post 341 integrally extend downward from the upper matching surface 34. The position limiting protrusion 342 is provided along the front-rear direction elongatedly, and extends to the front surface of the upper insulating block 3A. A height of the position limiting protrusion 342 is greater than a height of the positioning post 341. In this embodiment, the height of the position limiting protrusion 342 is greater than the height of the positioning post 341 by 0.03 mm. A stopping portion 343 extends downward from each of the left and right sides of the upper matching surface 34. Each stopping portion 343 also extends forward to the front surface of the upper insulating block 3A, and the two stopping portions 343 are provided at an interval in the left-right direction to define an opening 3430.

Referring to FIG. 3, FIG. 5 and FIG. 6, the second terminal module M2 is formed by a lower insulating block 3B and the terminals 2 in the lower row being integrally injection molded. The second terminal module M2 and the first terminal module M1 are 180° longitudinally symmetrical to each other, such that the upper surface of the lower insulating block 3B forms a lower matching surface 35. The upper insulating block 3A and the lower insulating block 3B fix and match with each other vertically, and the upper matching surface 34 and the lower matching surface 35 are provided opposite to each other vertically. The lower insulating block 3B and the upper insulating block 3A are 180° structurally symmetrical, and details are not elaborated herein.

Figure 4:
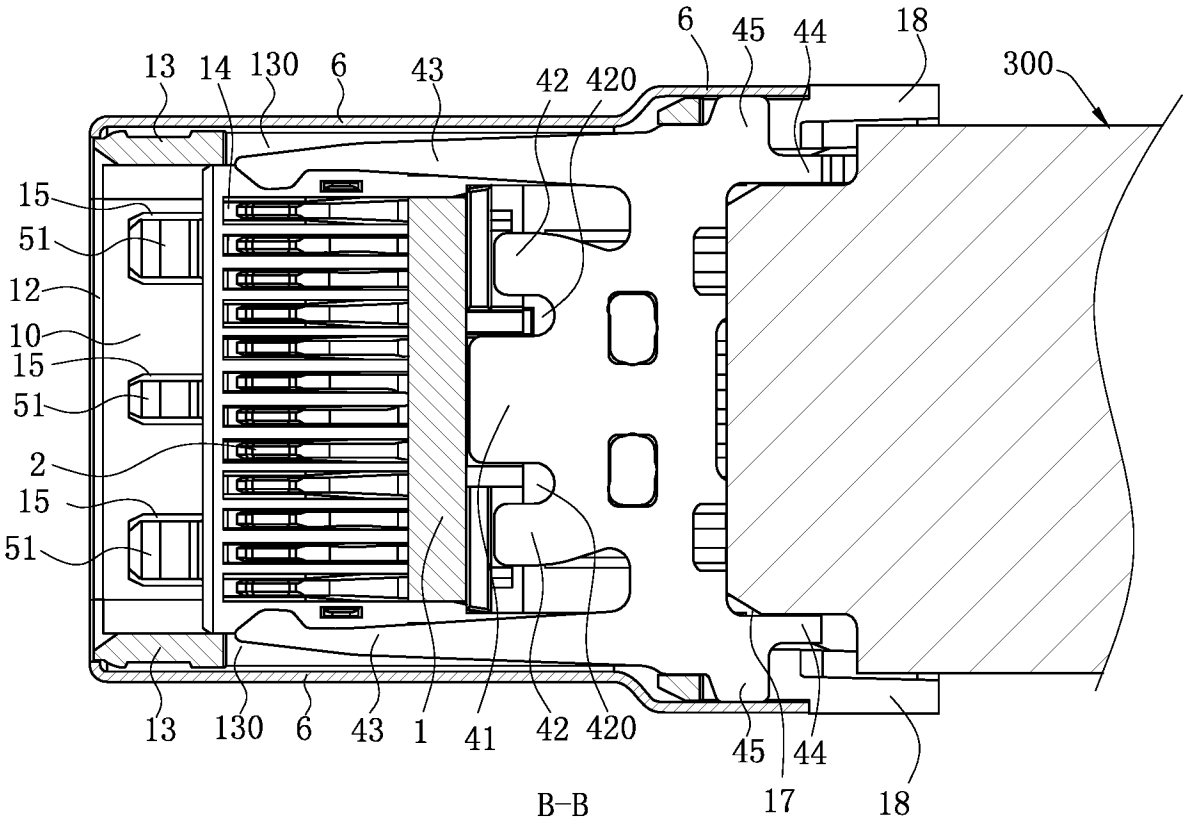
FIG. 4 is a sectional view of the electrical connector in FIG. 3 along the B-B direction.

Referring to FIG. 1, FIG. 4 and FIG. 5, a shielding sheet 4 is formed by stamping from a metal sheet metal. The shielding sheet 4 has a base 40, and the base 40 has two positioning holes 401 thereon. A first protruding portion 41 extends forward from a center of a front end of the base 40, and two second protruding portions 42 are located at the left and right sides of the first protruding portion 41. A notch 420 is formed between each second protruding portion 42 and the first protruding portion 41. The shielding sheet 4 has two latch arms 43, two pins 44 and two fastening portions 45. The two latch arms 43 extend forward from each of two sides of a rear end of the base 40 respectively. The two pins 44 extend backward from the left and right sides of the rear end of the base 40 respectively. Further, the two fastening portions 45 horizontally extend outward from the left and right sides of the rear end of the base 40 respectively. An elastic space is formed between the latch arms 43 and the base 40 to reserve for the elastic deformation of the latch arms 43. The pin 44 and the latch arm 43 on the same side of the shielding sheet 4 pass through the same straight line in the front-rear direction. One of the pins 44 bends upward, and the other pin 44 bends downward.

Referring to FIG. 1, FIG. 2 and FIG. 3, each grounding sheet 5 has a main body portion 50. The main body portion 50 has a buckling groove 501, and multiple first extending arms 51 and multiple second extending arms 52 extend forward from the main body portion 50. The first extending arms 51 and the second extending arms 52 are arranged in a row and are provided alternately. Each first extending arm 51 bends to be arc-shaped along the vertical direction. Each second extending arm 52 extends horizontally, and each second extending arm 52 is provided with a first elastic sheet 520 formed by tearing. The first elastic sheet 520 bends along the vertical direction, and a free end thereof faces backward. Multiple second elastic sheets 530 extend backward from the tail end of the main body portion 50. The second elastic sheets 530 are arranged in a row at equal intervals. Each second elastic sheet 530 bends along the vertical direction, and a free end thereof faces backward.

Referring to FIG. 1, FIG. 2 and FIG. 3, the metal shell 6 is a cylindrical structure running through in the front-rear direction, and is made of metal.

Referring to FIG. 1, FIG. 4 and FIG. 5, the first terminal module M1 and the second terminal module M2 are mounted and fixed together vertically, and the shielding sheet 4 is clamped between the upper matching surface 34 and the lower matching surface 35. The base 40, the first protruding portion 41 and the second protruding portions 42 are clamped and attached fixedly between the upper matching surface 34 and the lower matching surface 35. The position limiting protrusions 342 are first accommodated in the notches 420, and then the positioning post 341 is accommodated and fastened in the positioning hole 401. The height of each position limiting protrusion 342 is greater than the height of the positioning post 341, such that the position limiting protrusions 342 can match with the notches 420 first to preliminarily position the shielding sheet 4, thereby allowing the positioning post 341 to more easily enter the positioning hole 401, thus facilitating mounting and reducing the mounting error. The stopping portions 343 are correspondingly located in front of the second protruding portions 42 at the two sides to stop the second protruding portions 42 from moving forward. The position limiting protrusion 342 of the upper insulating block 3A and the limiting protrusion 342 of the lower insulating block 3B are located at two sides of the first protruding portion 41, and the front end of the first protruding portion 41 is exposed in the opening 3430. When the position limiting protrusions 342 limit the first protruding portion 41 from moving leftward or rightward, the opening 3430 facilitates heat dissipation of the first protruding portion 41. The rear end of the base 40 extends out of the rear surface of the upper insulating block 3A and the rear surface of the lower insulating block 3B, and is located between the second conduction portions 22 in the upper row and the lower row.

Referring to FIG. 1, FIG. 4 and FIG. 5, the first groove 31 is covered by the base 40 in the vertical direction, facilitating the reduction of crosstalk interference between two pairs of USB 2.0 terminals 2 vertically provided and exposed in the first groove 31. Each second groove 32 is covered by the base 40 and the corresponding second protruding portion 42 in the vertical direction, thereby facilitating the reduction of crosstalk interference between two pairs of differential signal terminals S vertically provided and exposed in each second groove 32.

The latch arms 43, the fastening portions 45 and the pins 44 are all exposed outside the upper insulating block 3A and the lower insulating block 3B.

Referring to FIG. 1, FIG. 3 and FIG. 4, the first terminal module M1, the second terminal module M2 and the shielding sheet 4, when completely mounted, are inserted into the accommodating cavity 17 together from rear to front, and the upper insulating block 3A and the lower insulating block 3B are fixed in the accommodating cavity 17. Each first conduction portion 21 extends forward into the mating cavity 10, and the first conduction portions 21 correspond to multiple terminal slots 14. Each first conduction portion 21 can perform elastic deformation in the corresponding terminal slot 14, and the first contact point 210 protrudes out of the corresponding terminal slot 14 to be exposed in the mating cavity 10, and is in mechanical contact with the socket connector 200. Each second conduction portion 22 extends backward out of the accommodating cavity 17, and the second contact point 220 is located in the accommodating cavity 17.

Referring to FIG. 2, FIG. 3 and FIG. 4, the latch arms 43 are accommodated in the channels 130, and the tail end of each of the latch arms 43 enters the accommodating cavity 17 and is fastened and fixed to the socket connector 200 to form a ground loop. The fastening portions 45 are received in the via holes 180, and each fastening portion 45 extends and protrudes from the corresponding side wall 18 in the left-right direction. The pins 44 extend out of the rear end of the insulating body 1 and are located between the two side walls 18.

Referring to FIG. 1, FIG. 2 and FIG. 3, the two grounding sheets 5 are mounted on the upper plate 11 and the lower plate 12 respectively. When one of the grounding sheets 5 is mounted on the upper plate 11, the buckling groove 501 is sleeved on the periphery of an upper protruding block and is fastened to the upper protruding block. Each first extending arm 51 is accommodated downward in the through hole 15 of the upper plate 11, and the arc-shaped portion of each first extending arm 51 is exposed in the mating cavity 10. Each second extending arm 52 is accommodated in the non-through hole 16 of the upper plate 11, and the first elastic sheet 520 and the second elastic sheets 530 bend and extend upward respectively.

When the other of the grounding sheets 5 is mounted on the lower plate 12, the buckling groove 501 is sleeved on the periphery of a lower protruding block and is fastened to the lower protruding block. Each first extending arm 51 is accommodated upward in the through hole 15 of the lower plate 12, and the arc-shaped portion of each first extending arm 51 is exposed in the mating cavity 10. The first elastic sheet 520 and the second elastic sheets 530 located on the lower plate 12 bend and extend downward respectively.

A metal shell 6 is inserted outside the insulating body 1 and the two grounding sheets 5 from front to rear. The first elastic sheet 520 and the second elastic sheets 530 are in mechanical contact with the upper and lower inner surfaces of the metal shell 6, and the two fastening portions 45 abut the left and right inner surfaces of the metal shell 6. The fastening portions 45 have good rigidity and abut the inner surfaces of the metal shell 6.

Referring to FIG. 9 and FIG. 10, the circuit board 300 is inserted forward into the accommodating cavity 17 and clamped between the second conduction portions 22 in the upper row and the lower row, and abuts the rear end of the shielding sheet 4. Two rows of first pads 301 are arranged on the upper and lower surfaces of the circuit board 300 respectively. Each first pad 301 is soldered and fixed to a corresponding second conduction portion 22, and the second contact point 220 is located in the middle of the corresponding first pad 301, thereby facilitating the soldering and fixing of the corresponding second conduction portion 22 on the first pad 301. The tail end of each second conduction portion 22 does not pass backward beyond a rear edge of the first pad 301. Compared with the scenario where the tail end of each second conduction portion 22 extends backward beyond the rear edge of the first pad 301, the invalid conductive paths of the second conduction portions 22 in this embodiment are reduced, facilitating the reduction of an antenna effect, thereby improving the high-frequency characteristics. Four second pads 302 are arranged in two rows to be longitudinally symmetrical and are distributed on the upper and lower surfaces of the circuit board 300. The two second pads 302 in the upper row are located behind two sides of the first pads 301 in the upper row, and the two second pads 302 in the lower row are located behind two sides of the first pads 301 in the lower row. The two second gaskets 302 in the upper row are soldered and fixed to one of the pins 44, and the two second pads 302 in the lower row are correspondingly soldered and fixed to the other pin 44.

To sum up, the electrical connector according to certain embodiments of the present invention has the following beneficial effects:

1. For the terminals 2 in this embodiment, the distance D1 between the first contact point 210 and the second contact point 220 is reduced, and D1=7.46±0.4 mm. The distance D2 between the connecting portion 20 in the upper row and the connecting portion 20 in the lower row in the vertical direction is increased, and D2=1.02±0.2 mm. Compared with the related art, a terminal impedance curve is completely within a standard impedance range, and the fluctuation of the front half part of the impedance curve is smaller than that of the terminal impedance curve in the prior art, such that the terminals 2 has good impedance characteristics, and the impedance of the terminals 2 is balanced, thereby facilitating the stability of high-frequency transmission performance.

2. D1 for each terminal 2 is smaller than D1 in the related art, thereby reducing the length of a transmission path of each terminal 2. When the Nyquist frequencies are in a range of 0 to 30 GHz, the insertion loss curve of the terminals 2 is within a standard range. Therefore, the transmission rate of the electrical connector 100 in this embodiment is at least 60 Gbps. Compared with the transmission rate of the conventional electrical connector 100, the transmission rate of the electrical connector 100 in this embodiment is higher, and more meets demands of a current trend.

3. Each pair of differential signal terminals S is correspondingly exposed in each second groove 32. A projection of the front wall surface of the second groove 32 in the vertical direction is on a joint between the transition section 203 and the second section 202, and the second section 202 is exposed in air. Since the distance between the differential signal terminals S in pair is reduced from t1 to t2 at the joint between the transition segment 203 and the second section 202, a dielectric coefficient needs to be reduced correspondingly to maintain the stability of impedance. The second groove 32 is full of air, and the dielectric coefficient of the air is smaller than the dielectric coefficient of the upper insulating block 3A. Therefore, by providing the front wall surface of each second groove 32 at the joint between the transition section 203 and the second section 202 of each differential signal terminal S, the stability of impedance can be effectively maintained.

4. The position limiting protrusions 342 are first accommodated in the notches 420, and then the positioning post 341 is accommodated and fastened in the positioning hole 401. The height of each position limiting protrusion 342 is greater than the height of the positioning post 341, such that the position limiting protrusions 342 can match with the notches 420 first to preliminarily position the shielding sheet 4, thereby allowing the positioning post 341 to more easily enter the positioning hole 401, thus facilitating mounting and reducing the mounting error.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, configured to electrically connect a first component to a second component, the electrical connector comprising:

an insulating block, having a first groove and a second groove located at one side of the first groove; and a plurality of terminals arranged in a row in a left-right direction, wherein the terminals in the row have a pair of differential signal terminals and a power terminal located at one side of the differential signal terminals;

wherein each of the terminals comprises:

a connecting portion;

a first conduction portion, extending forward from the connecting portion and configured to be electrically connected to the first component, wherein the first conduction portion has a first contact point in contact with the first component; and a second conduction portion, extending backward from the connecting portion and configured to be electrically connected to the second component, wherein the second conduction portion has a second contact point in contact with the second component, wherein a distance between the first contact point and the second contact point is 7.46±0.4 mm;

wherein the connecting portion of each of the terminals is fixed in the insulating block, the connecting portion of each of the terminals has two opposite sides in the left-right direction, one of the two opposite sides of the connecting portion of the power terminal is exposed in the first groove, the other of the two opposite sides of the connecting portion of the power terminal is embedded in the insulating block, and the two opposite sides of the connecting portion of each of the pair of differential signal terminals are both exposed in the second groove.

2. The electrical connector according to claim 1, wherein the connecting portion of each of the terminals extends forward out of a front surface of the insulating block and backward out of a rear surface of the insulating block, and a distance between the front surface and the rear surface of the insulating block is 3.45±0.2 mm.

3. The electrical connector according to claim 1, wherein a size of the first groove is smaller than a size of the second groove in a front-rear direction, and the size of the first groove is greater than the size of the second groove in the left-right direction.

4. The electrical connector according to claim 1, wherein the connecting portion of each of the differential signal terminals comprises a first section, a second section located behind the first section, and a transition portion connecting the first section and the second section, a distance between two adjacent first sections is greater than a distance between two adjacent second sections, the second groove has a wall surface, and a projection of the wall surface in a vertical direction is on a joint of the transition portion and the second section.

5. The electrical connector according to claim 1, wherein the terminals are arranged in an upper row and a lower row in a vertical direction, the insulating block further comprises an upper insulating block and a lower insulating block vertically matching each other, the terminals in the upper row are fixed to the upper insulating block, the terminals in the lower row are fixed to the lower insulating block, the upper insulating block has an upper matching surface facing the lower insulating block, the lower insulating block has a lower matching surface facing the upper insulating block, and a shielding sheet is clamped between the upper matching surface and the lower matching surface.

6. The electrical connector according to claim 5, wherein the second conduction portion of each of the terminals in the upper row extends backward out of a rear surface of the upper insulating block, the second conduction portion of each of the terminals in the lower row extends backward out of a rear surface of the lower insulating block, the shielding sheet extends backward out of the rear surface of the upper insulating block and the rear surface of the lower insulating block, and the second component is clamped between the second conduction portions in the upper row and the lower row and abuts the shielding sheet.

7. The electrical connector according to claim 5, wherein the shielding sheet has a base, a first protruding portion extending forward from a center of a front end of the base, and two second protruding portions respectively located at a left side and a right side of the first protruding portion, and the base, the first protruding portion and the second protruding portions are all clamped between the upper matching surface and the lower matching surface.

8. The electrical connector according to claim 7, wherein the base has at least one positioning hole, two notches are respectively formed between the first protruding portion and the two second protruding portions, at least one positioning post and two position limiting protrusions are located between the upper matching surface and the lower matching surface, the positioning post is accommodated in the positioning hole, the two position limiting protrusions are accommodated in the two notches respectively, and the position limiting protrusions are higher than the positioning post.

9. The electrical connector according to claim 7, wherein at least one stopping portion is located between the upper matching surface and the lower matching surface and is located in front of at least one of the two second protruding portions, and is configured to stop the second protruding portions backward.

10. An electrical connector, configured to electrically connect a first component to a second component, the electrical connector comprising:

an upper insulating block and a lower insulating block vertically matching each other; and a plurality of terminals arranged in an upper row and a lower row in a vertical direction, wherein the terminals in the upper row are fixed to the upper insulating block, the terminals in the lower row are fixed to the lower insulating block, the upper insulating block has an upper matching surface facing the lower insulating block, and the lower insulating block has a lower matching surface facing the upper insulating block;

wherein a shielding sheet is clamped between the upper matching surface and the lower matching surface, the shielding sheet has a base, a first protruding portion extending forward from a center of a front end of the base, and two second protruding portions respectively located at a left side and a right side of the first protruding portion, and the base, the first protruding portion and the second protruding portions are all clamped between the upper matching surface and the lower matching surface;

wherein two stopping portions are located between the upper matching surface and the lower matching surface and provided at an interval at two sides of a front end of the upper matching surface or at two sides of a front end of the lower matching surface, the two stopping portions are located in front of at least one of the two second protruding portions and are configured to stop the second protruding portions backward, an opening is located between the two stopping portions, and the first protruding portion is exposed in the opening; and wherein each of the terminals comprises:

a connecting portion;

a first conduction portion, extending forward from the connecting portion and configured to be electrically connected to the first component, wherein the first conduction portion has a first contact point in contact with the first component; and a second conduction portion, extending backward from the connecting portion and configured to be electrically connected to the second component, wherein the second conduction portion has a second contact point in contact with the second component, wherein a distance between the first contact point and the second contact point is 7.46±0.4 mm.

11. The electrical connector according to claim 1, further comprising an insulating body, wherein the terminals are accommodated in the insulating body, a mating cavity is concavely provided on a front end of the insulating body and configured to mate with the first component, an accommodating cavity is concavely provided on a rear end of the insulating body and configured to accommodate the second component, the first conduction portion is accommodated in the mating cavity, the first contact point is located in the mating cavity, the second conduction portion is accommodated in the accommodating cavity, and the second contact point is located in the accommodating cavity.

12. An electrical connector, configured to electrically connect a first component to a second component, the electrical connector comprising:

an insulating block having a first groove and a second groove;

an insulating body, comprising a mating cavity configured to mate with the first component; and a plurality of terminals fixed to the insulating body and arranged in an upper row and a lower row inside the mating cavity in a vertical direction, wherein the terminals are fixed in the insulating block, the terminals in the upper row and the terminals in the lower row are respectively arranged in a left-right direction, and the terminals in each of the upper row and the lower row have a pair of differential signal terminals and a power terminal located at one side of the differential signal terminals;

wherein each of the terminals comprises:

a connecting portion;

a first conduction portion, extending forward from the connecting portion and configured to be electrically connected to the first component, and a second conduction portion, extending backward from the connecting portion and configured to be electrically connected to the second component, wherein the connecting portion of each of the terminals in the upper row corresponds to the connecting portion of a corresponding one of the terminals in the lower row, and a distance between the connecting portion of each of the terminals in the upper row and the connecting portion of the corresponding one of the terminals in the lower row is 1.02±0.1 mm;

wherein the connecting portion of each of the terminals has two opposite sides in the left-right direction, one of the two opposite sides of the connecting portion of the power terminal is exposed in the first groove, the other of the two opposite sides of the connecting portion of the power terminal is embedded in the insulating block, and the two opposite sides of the connecting portion of each of the pair of differential signal terminals are both exposed in the second groove.

13. The electrical connector according to claim 12, wherein the insulating block is accommodated in the insulating body, the connecting portion of each of the terminals is embedded in the insulating block, the first conduction portion has a first contact point in electrical contact with the first component, the second conduction portion has a second contact point in electrical contact with the second component, and a distance between the first contact point and the connecting portion in the vertical direction is greater than a distance between the second contact point and the connecting portion in the vertical direction.

14. The electrical connector according to claim 12, wherein the insulating block further comprises an upper insulating block and a lower insulating block vertically matching each other, the terminals in the upper row are fixed to the upper insulating block, the terminals in the lower row are fixed to the lower insulating block, the upper insulating block has an upper matching surface facing the lower insulating block, the lower insulating block has a lower matching surface facing the upper insulating block, and a shielding sheet is clamped between the upper matching surface and the lower matching surface.

15. The electrical connector according to claim 14, wherein the second conduction portion of each of the terminals in the upper row extends backward out of a rear surface of the upper insulating block, the second conduction portion of each of the terminals in the lower row extends backward out of a rear surface of the lower insulating block, the shielding sheet extends backward out of the rear surface of the upper insulating block and the rear surface of the lower insulating block, and the second component is clamped between the second conduction portions in the upper row and the lower row and abuts the shielding sheet.

16. The electrical connector according to claim 14, wherein the shielding sheet has a base, a first protruding portion extending forward from a center of a front end of the base, and two second protruding portions respectively located at two sides of the first protruding portion, the base, the first protruding portion and the two second protruding portions are all clamped between the upper matching surface and the lower matching surface, the base has at least one positioning hole, two notches are respectively formed between the first protruding portion and the two second protruding portions, at least one positioning post and two position limiting protrusions are located between the upper matching surface and the lower matching surface, the positioning post is accommodated in the positioning hole, the two position limiting protrusions are accommodated in the two notches respectively, and the position limiting protrusions are higher than the positioning post.

17. The electrical connector according to claim 16, wherein at least one stopping portion is located between the upper matching surface and the lower matching surface and is located in front of at least one of the two second protruding portions, and is configured to stop the second protruding portions backward.

18. The electrical connector according to claim 16, wherein an accommodating cavity is provided at a rear end of the insulating body and configured to accommodate the second component, the first conduction portion has a first contact point in contact with the first component, the first contact point is located in the mating cavity, the second conduction portion is accommodated in the accommodating cavity, the second conduction portion has a second contact point in contact with the second component, the second contact point is located in the accommodating cavity, and a distance between the first contact point and the second contact point is 7.46±0.4 mm.

19. The electrical connector according to claim 10, wherein the second conduction portion of each of the terminals in the upper row extends backward out of a rear surface of the upper insulating block, the second conduction portion of each of the terminals in the lower row extends backward out of a rear surface of the lower insulating block, the shielding sheet extends backward out of the rear surface of the upper insulating block and the rear surface of the lower insulating block, and the second component is clamped between the second conduction portions in the upper row and the lower row and abuts the shielding sheet.

20. The electrical connector according to claim 10, wherein the base has at least one positioning hole, two notches are respectively formed between the first protruding portion and the two second protruding portions, at least one positioning post and two position limiting protrusions are located between the upper matching surface and the lower matching surface, the positioning post is accommodated in the positioning hole, the two position limiting protrusions are accommodated in the two notches respectively, and the position limiting protrusions are higher than the positioning post.

* * * * *